US009024732B2

(12) United States Patent
Huang et al.

(10) Patent No.: US 9,024,732 B2
(45) **Date of Patent: *May 5, 2015**

(54) METHOD OF REMOTELY CONTROLLING GAS APPLIANCE AND THE REMOTE CONTROL SYSTEM

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW)

(73) Assignee: Grand Mate Co. Ltd., Taichung (TW)

( * ) Notice: Subject to any disclaimer, the term of this patent is extended or adjusted under 35 U.S.C. 154(b) by 48 days.

This patent is subject to a terminal disclaimer.

(21) Appl. No.: 13/958,897

(22) Filed: Aug. 5, 2013

(65) Prior Publication Data

US 2013/0317651 A1 Nov. 28, 2013

Related U.S. Application Data

(63) Continuation of application No. 12/985,128, filed on Jan. 5, 2011.

(51) Int. Cl.

| | |
|---|---|
| ***G05B 11/01*** | (2006.01) |
| ***G05B 21/00*** | (2006.01) |
| ***F23N 5/26*** | (2006.01) |
| ***F24C 3/00*** | (2006.01) |

(52) U.S. Cl.
CPC .. *F23N 5/265* (2013.01); *F24C 3/00* (2013.01)

(58) Field of Classification Search
None
See application file for complete search history.

(56) References Cited

U.S. PATENT DOCUMENTS

| | | | | |
|---|---|---|---|---|
| 7,363,031 | B1 * | 4/2008 | Aisa | 455/419 |
| 8,559,030 | B2 * | 10/2013 | Tsongas et al. | 358/1.14 |
| 2008/0055108 | A1 * | 3/2008 | Han et al. | 340/825.22 |
| 2009/0199255 | A1 * | 8/2009 | Yasrebi et al. | 725/118 |
| 2012/0006032 | A1 * | 1/2012 | Kopcho et al. | 60/772 |

* cited by examiner

*Primary Examiner* — Steven Lim
*Assistant Examiner* — Omeed Alizada
(74) *Attorney, Agent, or Firm* — Tracy M Heims; Apex Julis, pllc

(57) ABSTRACT

The present invention provides a remote control system that includes at least a gas appliance; a repeater, and a remote control device. The gas appliance is connected to the repeater through a Zigbee transmission, and the remote control device is connected to the repeater through a network (internet or telecommunication network). User inputs a command at the remote control device, and the remote control device transmits the command to the repeater through the network, and then the repeater will control the gas appliance according to the command. The gas appliance is provided with sensors to detect data in regards to the gas appliance. The data is transmitted to the remote control device and shown on a screen through the repeater and the network.

3 Claims, 5 Drawing Sheets

METHOD OF REMOTELY CONTROLLING GAS APPLIANCE AND THE REMOTE CONTROL SYSTEM

CROSS REFERENCE TO RELATED APPLICATIONS

This application is a continuation in part of application Ser. No. 12/985,128 filed on Jan. 5, 2011.

BACKGROUND OF THE INVENTION

1. Field of the Invention

The present invention relates generally to gas appliance, and more particularly, to a method of remotely controlling gas appliances and the remote control system.

2. Description of the Related Art

Gas appliances, which are the device burning gas to perform a specific function, such as gas water heater, gas stove, gas clothing dryer and gas fireplace, have a high level of safety issue in home life. Usually, it has a limitation in installation and operation of the gas appliances, such as the gas water heater which must be installed outdoors, the gas stove is provided with a safety device to automatically cut off gas when the temperature is too high, or when the flame is out unexpectedly.

In most cases, a user has to walk to the gas appliance to operate it. However, it is very frustrating for the user to go outdoors in a cold weather to operate the water heater. It is for this reason, some had developed water heater that the user may operate from indoors.

For example, in very cold weather, the fireplace needs time to warm up the room that, it has to be turned on a couple hours before the user arrives home. Such circumstance cannot be resolved by using remote control because the remote control only works within a limited distance.

In addition, there are usually a lot of gas appliances at home, each equipped with a specific remote control that the user often has trouble finding the matching remote control to operate the gas appliance.

SUMMARY OF THE INVENTION

The primary objective of the present invention is to provide a method of monitoring a gas appliance, with which the user may remotely control the gas appliances and obtain a message when an abnormity is found in the gas appliances.

According to the objective of the present invention, the present invention provides a remote control system which includes at least a gas appliance including a combustor, a gas supply, a controller; a repeater including a processor to be connected to the controller of the gas appliance, a port to be connected to a network; and a remote control device connected to the repeater through the network. The remote control device transmits a command to the repeater through the network, and the repeater generates a control signal to control the gas appliance to carry out a specific action.

In an embodiment, the present invention provides a method of remotely controlling the gas appliance, including connecting a remote control device to the repeater through a network; inputting a command at the remote control device; transmitting the command to the repeater through the network; and generating a control signal according to the command, then transmitting the control signal to the gas appliance to control the gas appliance.

In an embodiment, the remote control device is a telephone or a cell phone, and the network is a telecommunication network, and in another embodiment, the remote control device is a computer, a smartphone, or a personal digital assistant (PDA), and the network is internet or intranet.

In an embodiment, the gas appliance and repeater are provided a Zigbee transceiver respectively for communication between the gas appliance and repeater.

In an embodiment, the gas appliance further is provided with at least a sensor to detect data regarding the gas appliance, and the data is then transmitted to the remote control device through the repeater and the network.

In an embodiment, the data is transmitted to the remote control device after user inputs a command at the remote control device, to control the repeater and the data it transmits to the remote control device.

In an embodiment, the data is examined, and is shown on the remote control device when the data being examined appear to be abnormal.

In an embodiment, the repeater is installed with a program, and the remote control device is installed with a program to be communicated with the program of the repeater.

In an embodiment, the repeater is provided with a control panel to be operated by user to control the gas appliance.

In an embodiment, the repeater is provided with a screen.

Therefore, the present invention may synchronize functions of various gas appliances at home, and control them by an ordinary device such as cell phone and computer, from a distance away from home.

DETAILED DESCRIPTION OF THE INVENTION

A system for remotely controlling gas appliances of the embodiment of the present invention includes a plurality of gas appliances 10, a repeater 20, a network 30, and a remote control device 40.

Figure 1:
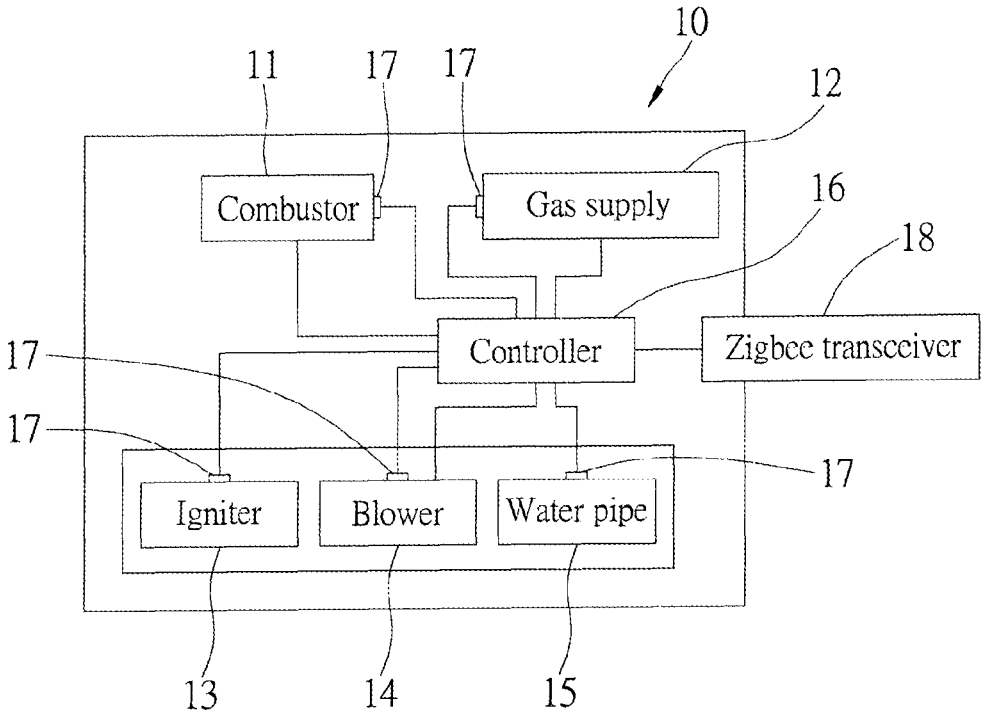
FIG. 1 is a block diagram of the gas appliance of a preferred embodiment of the present invention.

As shown in FIG. 1, the gas appliances in the present invention include gas water heater, gas stove, gas clothing dryer, gas fireplace, and other devices which burn gas to achieve specific functions. Typically, such gas appliance 10 has a combustor 11, a gas supply 12 and other peripheral devices. The gas supply 12 supplies the combustor 11 gas for burning. The peripheral devices here are the other elements apart from the combustor 11 and gas supply 12, in the specific gas appliance. Take the water heater for example; the peripheral devices include an igniter 13, a blower 14, and water pipe 15. Different gas appliances may have different peripheral devices. In the present invention, the gas appliance 10 further has a controller 16 and a plurality of sensors 17. The combustor 11, the gas supply 12, the peripheral devices 13, 14, 15, and the sensors 17, are all connected to the controller 16 that the controller 16 may tell the gas appliance 10 to carry out specific functions such as turning on and off the gas appliance, or changing temperature. The sensors 17 are mounted on the combustor 11, the gas supply 12, and the peripheral devices 13, 14, and 15 to detect their data when they are running, and to transmit the data to the controller 16. In the present embodiment, the gas appliance 10 further has a Zigbee transceiver 18 for communication between the gas appliance 10 and the repeater 20 via wireless transmission.

Figure 2:
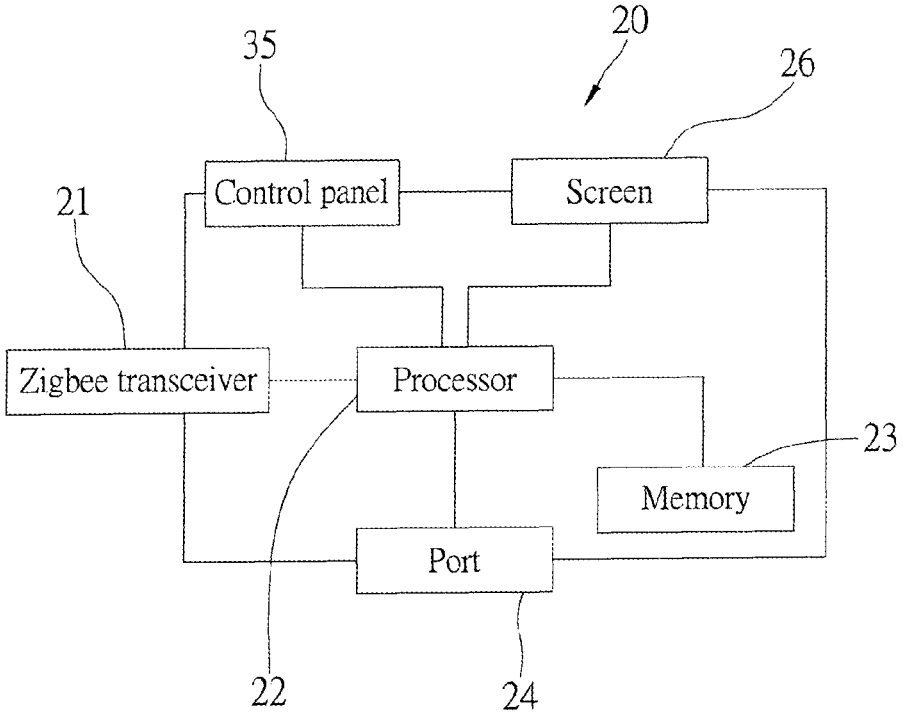
FIG. 2 is a block diagram of repeater of the preferred embodiment of the present invention.

As shown in FIG. 2, the repeater 20 may be mounted indoors, which has a Zigbee transceiver 21 for communication with the Zigbee transceiver 18 of the gas appliance 10. The repeater 20 further has a processor 22, a memory 23, a port 24, a control panel 25, and a screen 26. The memory 23, the port 24, the control panel 25, and the screen 26 are all connected to the processor 22, and controlled by the processor 22. The control panel 25 may be operated by user to control the gas appliance 10 manually. The screen 26 may show the relative information about the gas appliance 10. In practice, after user operates the control panel 22, it will generate a signal to transmit to the processor 22, and then the processor 22 will transmit it to the controller 16 of the gas appliance 10 through a wireless transmission between the Zigbee transceivers 21 and 18 that, user may control the gas appliance 10 by the repeater 20, to achieve a specific function, such as turning on and off, or adjusting the flame or temperature. On the contrary, the sensors 17 will transmit signals of what they detected to the controller 16, and the controller 16 will transmit them to the repeater 20 through the same way that the screen 26 may show some information about the gas appliance 10. The port 24 may be connected to the network 30. In the present invention, the network 30 may be an internet, an intranet, a telecommunication network, or other network for long-distance communication. The remote control device 30 may be communicated with the repeater 20 through a remote control device 40.

Figure 3:
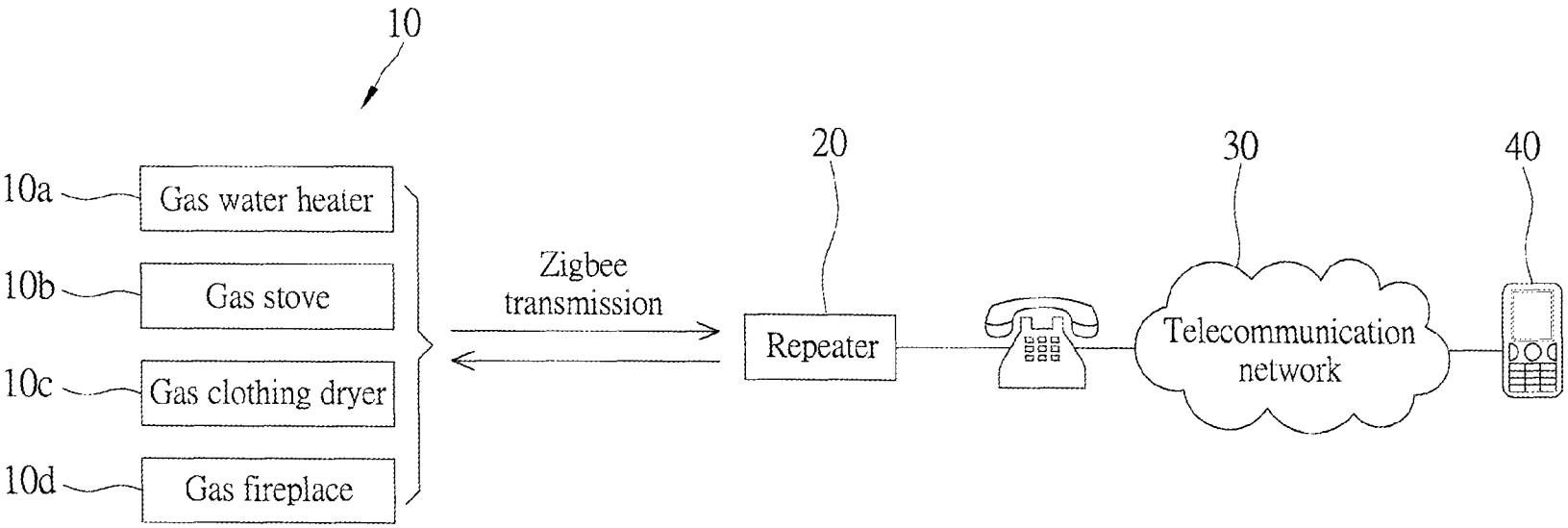
FIG. 3 is a sketch diagram of the remote control system of the preferred embodiment of the present invention.

As shown in FIG. 3, a remote control system of a preferred embodiment of the present invention includes gas appliances 10, a repeater 20, and a remote control device 40. The gas appliances 10 includes a water heater 10*a*, a gas stove 10*b*, a clothing dryer 10*c*, and a fireplace 10*d*, which are connected to a repeater 20 through a Zigbee transmission. The remote control device 40 may be a telephone or a cell phone (we take the cell phone to be the remote control device 40 in this embodiment). The cell phone 40 communicates with the repeater 20 through a telecommunication network 30. After user dials a specific number, the cell phone 40 is connected to the repeater 20, and then user may give a command to the repeater 20 by pressing specific key(s) on the cell phone 40, or by recording a voice message. The repeater 20 will generate a control signal according to the command from the cell phone 40. The control signal includes an identification data and a command data. The identification data indicates which gas appliance should receive the command, and the command data tells the gas appliance to carry out a predetermined task. For example, when the identification data indicates that the gas stove 10*b* should take the command, and the command data indicates that the gas supply 12 are to be turned on, and the igniter 13 to light a fire, such that the gas stove 10*b* is turned on.

The sensors 17 detect some data regarding the gas appliance 10, such as gas flow rate, speed of the blower, temperature of the combustor, etc., and transmit these data to the repeater 20 via the Zigbee transmission. When user uses the cell phone 40 and sends a specific number to the repeater 20, it will command the repeater 20 to send the detected data to the cell phone 40. These data may be in the form of a text message or voicemail.

When the sensor 17 detects an abnormal condition, such as when the temperature is too high, a problem with gas leakage, or other situations, the processor 22 of the repeater 20 will automatically send a warning message in the form of a text message or voicemail to the cell phone 40 to notify the user.

Figure 4:
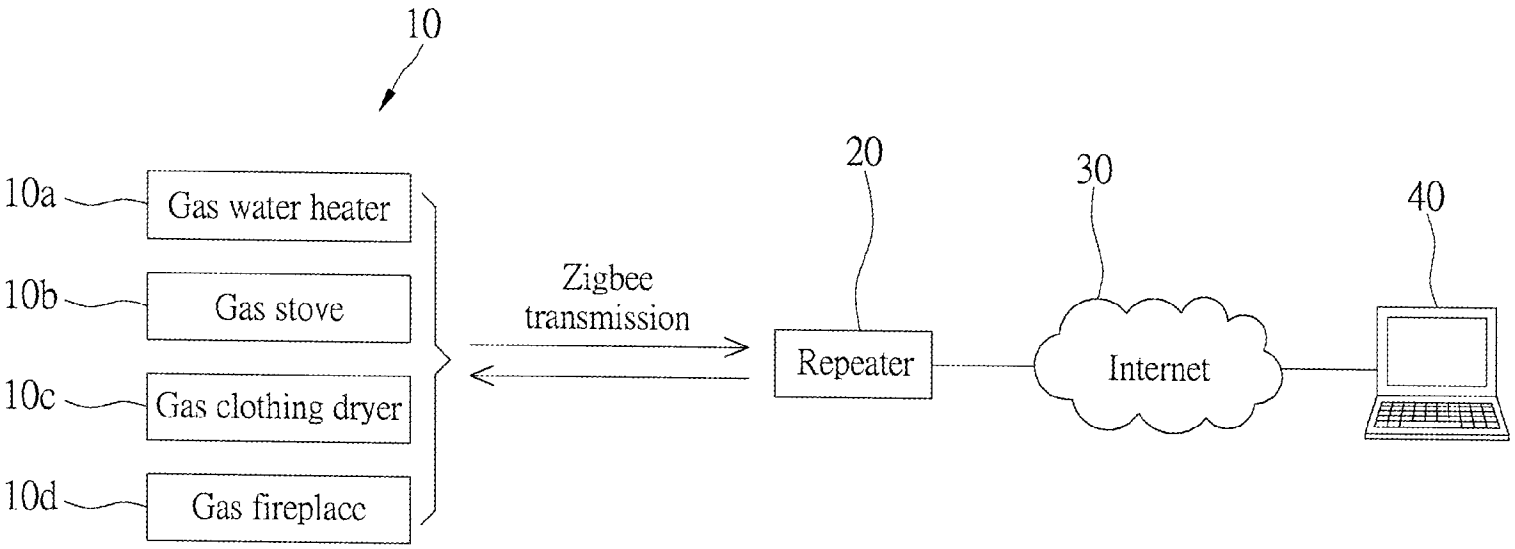
FIG. 4 is a sketch diagram of another remote control system of the preferred embodiment of the present invention.

As shown in FIG. 4, in a preferred embodiment, the network 30 is internet, and the remote control device 40 may be a desktop computer, a laptop, tablet computer, a smartphone, a PDA, or other computers that may be connected to internet (hereunder, we take the laptop computer for example to be the remote control device 40). The repeater 20 is connected to the internet 30 through the port 21 to connect the laptop computer 40. The laptop computer 40 and the repeater 20 are installed with specific program for communication therebetween through the internet 30. When user executes the program and selects a command in the program, this command is then transmitted to the repeater 20 through the internet 30, and the repeater 20 generates a control signal which includes an identification data, and a command data as described above, to appoint the specific gas appliance to carry out a specific action. For example, the identification data indicates the water heater 10*a*, and the command data indicates the gas supply 12 to raise the gas flow rate that in the end, the water temperature of the water heater 10*a* will be raised.

The sensors 17 of the gas appliance 10 detect some data in regards to the gas appliance 10, such as gas flow rate, speed of the blower, and temperature etc., and these data are transmitted to the repeater 20 through the Zigbee transmission. The repeater 20 will transmit the data to the laptop computer 40 through the internet 30 that user get the real time information about the gas appliances 10*a*, 10*b*, 10*c*, and 10*d*.

When the data detected by the sensor 17 of the gas appliance is examined to be in abnormal condition, such as when the temperature is too high, or when there is a problem with gas leakage etc., the program of the laptop computer will automatically provide a warning message, either audio or with flashing light, to warn user.

Figure 5:
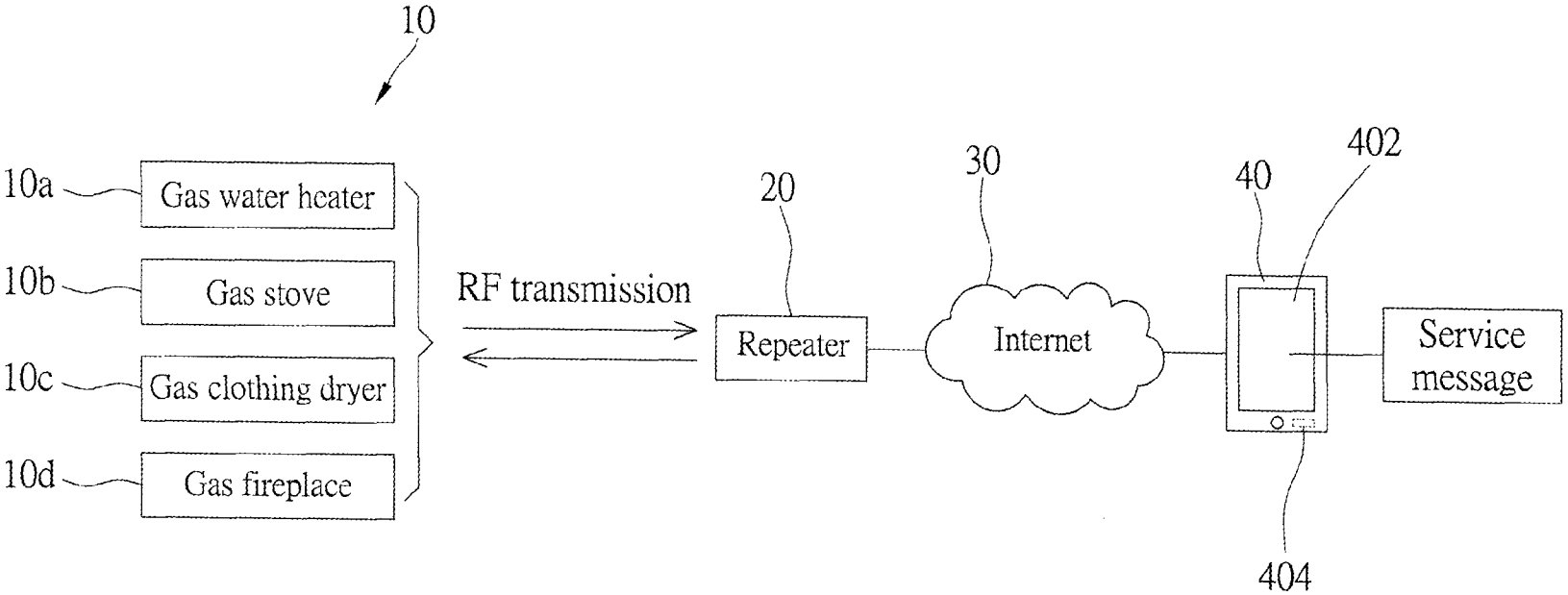
FIG. 5 is a sketch diagram of the third remote control system of the preferred embodiment of the present invention.
Figure 6:
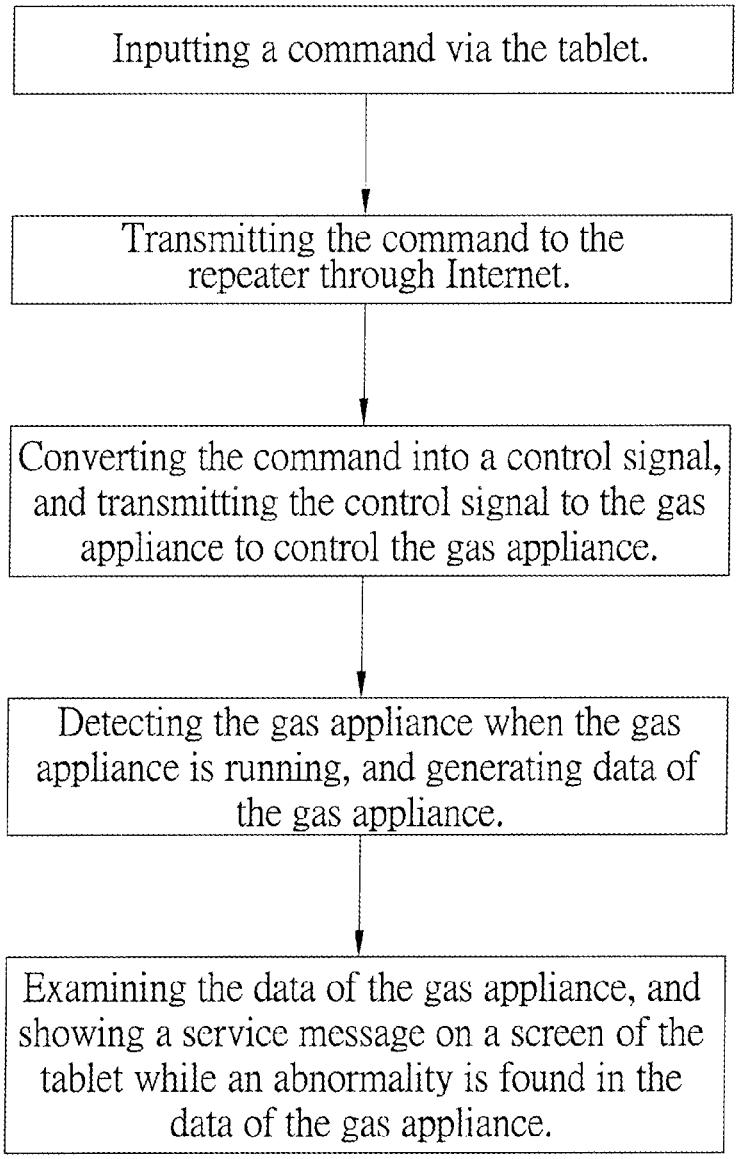
FIG. 6 is a flowchart of the third remote control system of the preferred embodiment of the present invention.

As shown in FIG. 5, in another embodiment, the remote control system of the gas appliance is similar to above embodiments, except that the wireless signal transmission between the gas appliance 10*a*, 10*b*, 10*c*, and 10*d* and the repeater 20 is via radio frequency. The remote control device 40 is a tablet, which has a screen 402 and a speaker 404. As shown in FIG. 6, the monitoring method including the following steps:

The tablet 40 executes a specific application to show an interface on the screen 402. The user may input a command through the interface, and the command will be transmitted to the repeater 20 through the Internet 30 and is converted into a control signal in the repeater 20. The control signal will be sent to a specified gas appliance 10 to control it. On the contrary, the data detected by the sensor 17 of the gas appliance 10 will be sent to the tablet 40 through the repeater 20 and the Internet 30 to show the message on the screen 404.

The tablet 40 is stored with a database therein, which stores parameters of normal function of the gas appliances 10, codes of abnormities, and data of users, including name, address, model of the gas appliance, and so on.

The data sensed by the sensor 17 is compared with the parameters of the database in the table 40, and if any abnormality in the data is found, the tablet 40 will show a service message on the screen 402. The service message includes a hyperlink, which links to a specific page of a troubleshooting website according to the code of abnormity. One may get some information on the troubleshooting website, including the procedures of troubleshooting, video of how to troubleshoot, or telephone numbers and addresses of the service stations (it may show the nearest service station at the top of the list). One may fix the problem of the gas appliance 10 by himself/herself or just call for help.

The tablet 40 will generate an alarm when an abnormality of the gas appliance 10 is found to warn the user. The alarm includes voice messages or sounds coming from the speaker 404, a warning window poping up on the screen 402, and so on.

The remote control system of the present invention provide user to control the gas appliances, such as gas water heater, gas stove, gas clothing dryer, and fireplace etc., without the time and distance limitation. As along as the user can connect the remote control device to a network, such as internet, intranet, or telecommunication network etc., he/she can control the gas appliances. In addition, the system of the present invention may synchronize functions of various gas appliances in home that user may control these gas appliances by one remote control device. For example, when a user is on their way home or he/she is leaving from work, he/she can use the system of the present invention to turn on the fireplace by a cell phone or a laptop computer that, it may allow sufficient time for the fireplace to warm up the room in a house, or you are reminded that the gas stove is still turned on (or you just can't be certain) when you left home, you can use the system of the present invention to remotely control the gas stove.

The present invention makes the user may obtain the status of the gas appliance anytime and anywhere, and he/she can get a message in a very short time while the abnormality is occurred. Furthermore, the user may get the information of troubleshooting or how to call for help immediately. It may avoid a big accident and shorten the time to repair the gas appliance.

The description above is a few preferred embodiments of the present invention and the equivalence of the present invention is still in the scope of claim construction of the present invention.

What is claimed is:

1. A method of monitoring a gas appliance, wherein at least a gas appliance is connected to a repeater, and the repeater is connected to a remote control device through an internet, the method comprising the steps of:

inputting a command via the remote control device;

transmitting the command to the repeater through the internet;

converting the command into a control signal, and then transmitting the control signal to the gas appliance to control the gas appliance;

detecting the gas appliance when the gas appliance is running, and generating data of the gas appliance;

examining the data of the gas appliance; and showing a service message on a screen of the remote control device while an abnormality is found in the data of the gas appliance, the service message providing a solution to fix the abnormality of the gas appliance;

wherein the service message includes information of a service station or wherein the service message includes a hyperlink, and the hyperlink links to a website on which a method of troubleshooting is shown; and when the abnormality can be solved by troubleshooting, the service message includes the method of troubleshooting, or when the abnormality has safety concerns, the service message includes information of the service station.

2. The method as defined in claim 1, wherein the data of the gas appliance is transmitted to the remote control device through the repeater and the internet, and then the data is examined in the remote control device.

3. The method as defined in claim 1, further comprising the step of sounding an alarm on the remote control device while the abnormality is found in the data of the gas appliance.

* * * * *